US005886725A

United States Patent [19]

Miyadera et al.

[11] Patent Number: 5,886,725

[45] Date of Patent: Mar. 23, 1999

[54] THERMAL PRINTER HAVING A PIVOTAL THERMAL HEAD UNIT

[75] Inventors: Toshiyuki Miyadera; Fumio Matsui, both of Saitama-ken; Naoki Yoshida, Tokyo, all of Japan

[73] Assignee: Pioneer Electronic Corporation, Tokyo, Japan

[21] Appl. No.: 614,248

[22] Filed: Mar. 12, 1996

[30] Foreign Application Priority Data

Mar. 17, 1995 [JP] Japan ..... 7-059156

[51] Int. Cl.[6] ..... B41J 2/32; B41J 2/335

[52] U.S. Cl. ..... 347/197

[58] Field of Search ..... 347/197, 198, 347/174, 175; 346/138; 400/120.16, 120.17; 358/296; 271/275, 277; 101/409, 415.1; 399/303, 304, 377

[56] References Cited

U.S. PATENT DOCUMENTS 4,660,825 4/1987 Umezawa ..... 271/276
4,750,880 6/1988 Stephenson et al. ..... 347/197
5,353,049 10/1994 Ro et al. ..... 346/138
5,541,635 7/1996 Wills et al. ..... 347/197

*Primary Examiner*—N. Le
*Assistant Examiner*—L. Anderson
*Attorney, Agent, or Firm*—Nikaido Marmelstein Murray & Oram LLP

[57] ABSTRACT

There is provided a thermal printer for performing a printing operation by way of heat. This printer comprises a casing, drum means provided within the casing for rolling up a paper to be printed, and a thermal head unit provided within the casing for producing a heat for the printing operation. In detail, the thermal head unit has a pair of brackets provided on the opposite sides thereof, each of the two brackets being formed at one end thereof with an elongated hole into which a fixed shaft is to be inserted, and being supported at the other end thereof on the main body of the thermal head unit, such that the thermal head unit is pivotable only in a direction perpendicular to a printing direction.

9 Claims, 8 Drawing Sheets

90
100
101
102
103
104
105
106a
106b
106c
107
108
109
170
171
172
100a
94
H
H1

THERMAL PRINTER HAVING A PIVOTAL THERMAL HEAD UNIT

BACKGROUND OF THE INVENTION

This invention relates to a printer, particularly to a thermal printer adapted to print characters or a picture by generating a heat from a thermal head.

Usually, a thermal printer has a thermal head which comprises a large number of exothermic resistors arranged on an insulating base. By selectively supplying electric current to the exothermic resistors, a Joule heat is generated which is applied to a thermosensible paper or an ink film so as to print characters or a picture.

FIG. 7 shows the basic construction of a conventional thermal printer comprising a drum 3, an ink film 4 and a thermal head 2. As illustrated in FIG. 7, a paper 1 is clamped to the drum 3 using a clamping means (not shown) so as to be positioned between the drum 3 and the ink film 4. The thermal head 2 is caused to press the ink film 4 against the paper 1, thereby printing characters or pictures on the paper 1 using the heat from the thermal head 2.

FIG. 8 shows in detail an example of the thermal head 2. Referring to FIG. 8, the thermal head 2 comprises an aluminum base 5. Provided under the aluminum base 5 is a ceramic base 6 having a number of exothermic members, a substrate member 7 for exothermic member driving circuit, a protection cover 8 for covering the substrate member 7. Further, a plurality of heat radiation fins 11 are integrally formed on the aluminum base 5.

FIG. 9 shows in detail an example of a clamping means 20 generally used in the above conventional thermal printer. Referring to FIG. 9, the clamping means 20 has a plurality of pressing members 21 which are provided so as to easily get contact with the drum 3 or leave therefrom. In use, the paper 1 is fed inwardly until it gets to a stopper member 22, thus the front portion of the paper 1 will be clamped to the drum 3 by virtue of the pressing members 21. Then, with the proceeding of the operation, the drum 3 is rotated to cause the paper 1 to be rolled gradually around the outer periphery of the drum 3. Further, with the use of pressing rollers 23, the paper 1 is pressed against the drum 3 so that it gets tight contact with the outer periphery of the drum 3.

When the printing operation is performed, the thermal head 2 is caused to press the ink film 4 against the paper 1, thereby printing characters or pictures on the paper 1, using the heat from the thermal head 2. During the printing operation, the drum 3 is rotated at a speed corresponding to a printing speed of the thermal head 2, whilst the ink film 4 is moved at a speed corresponding to the drum speed.

The ink film 4 includes four color areas (for example, yellow, magenta, cyanogen, black) which are arranged successively and in a manner such that the four color areas appear repeatedly on the ink film 4 along the entire length thereof. As soon as the printing of a first color (yellow) is finished, the drum 3 is rotated to return to its home position, so that the front portion of the same paper 1 is caused to be coincident with that of a second color (magenta) area of the ink film 4. In the same manner, a third color (cyanogen) and a fourth color (black) may be printed on the paper 1 so as to obtain a completed color picture.

The thermal head 2 used in the above thermal printer is pivotably supported on the printer cover member through appropriate bracket means, such that the thermal head 2. can easily get contact with the drum 3 and easily leave therefrom. When the paper 1 is being clamped around the drum 3 or is being discharged therefrom, the thermal head 2 can leave from the drum 3 when the drum rotates, so that the thermal head 2 is prevented from any possible damage due to a friction with the drum 3.

However, in the above thermal printer, since it is impossible for the thermal head 2 to absorb a possible thickness difference in a single piece of paper, the thermal head 2 fails to get uniform contact with the paper 1, resulting in a problem such as irregular color printing.

Moreover, in the above thermal printer, since the thermal head 2 receives a vibration from the drum 3 while the drum rotates, the relative position of the thermal head 2 with respect to the drum 3 will gradually change with the passing of time, rendering the thermal printer to be unreliable in actual use.

SUMMARY OF THE INVENTION

An object of the present invention is to solve the above-mentioned problems peculiar to the above-mentioned prior art and to provide an improved thermal printer capable of printing a clear picture without irregular color.

Another object of the present invention is to provide an improved thermal printer having a higher reliability in printing operation without being affected due to a long time use.

According to the present invention, there is provided a thermal printer for performing a printing operation by means of a heat. This printer comprises a casing, drum means provided within the casing for rolling up a paper to be printed, and a thermal head unit provided within the casing for producing a heat for the printing operation. In detail, the thermal head unit has a pair of brackets provided on the opposite sides thereof, each of the two brackets being formed at one end thereof with an elongated hole into which a fixed shaft is to be inserted, and being supported at the other end thereof on the main body of the thermal head unit, such that the thermal head unit is pivotable only in a direction perpendicular to a printing direction.

Further in detail, the two elongated holes are formed with their longitudinal axis arranged in the pivoting direction of the thermal head unit, and into the two elongated holes of the two brackets is inserted an elongated shaft secured within the casing, so that the elongated shaft extends between the two brackets.

In one aspect of the present invention, the thermal head unit further includes an intermediate bracket provided adjacent to the center of the thermal head unit. In detail, the intermediate bracket is formed with an elongated hole, a bolt member is inserted through the elongated hole and is fixed on the above elongated shaft, such that the thermal head unit is slightly vertically pivotable about the bolt member.

In another aspect of the present invention, between the above intermediate bracket and the above elongated shaft is provided a spring means for absorbing a vibration applied to the thermal head unit.

In a further aspect of the present invention, the drum means is provided with a clamp mechanism having a plurality of clamp members each being independently held by a leaf spring.

In a still further aspect of the present invention, the drum means is further provided with a pair of sliding members on the opposite end faces thereof, each of said sliding members is urged by a spring and is caused to cooperate with an arm member and a moving member, so as to cause the sliding members to slid up and down along the end faces of the drum means. Further, the moving member is controlled by a solenoid to advance to and retreat from the moving locus of the arm member on the end face of the drum means.

The above objects and features of the present invention will become more understood from the following description with reference to the accompanying drawings.

BRIEF DESCRIPTIONON OF DRAWINGS

Figure 1:
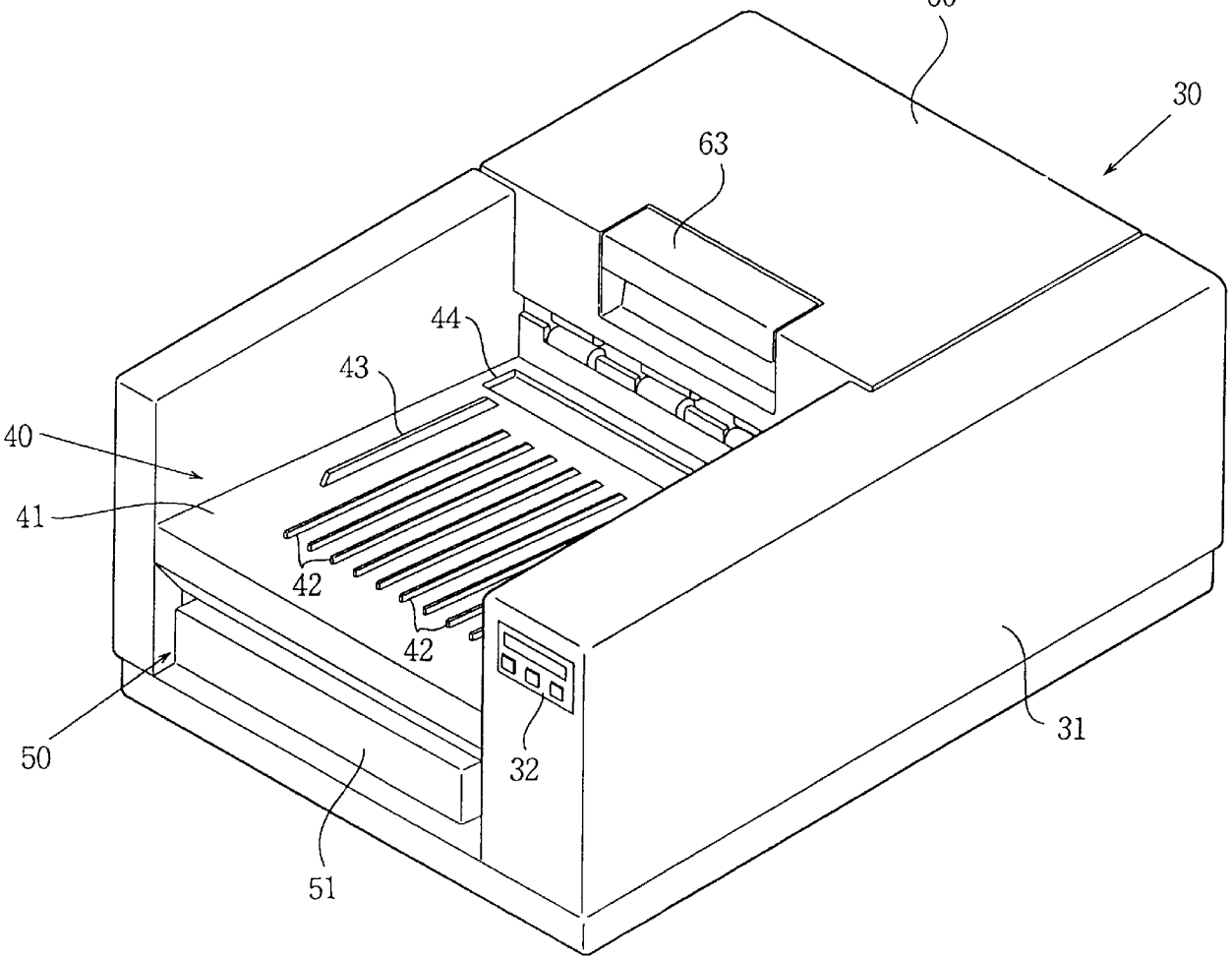
FIG. 1 is a perspective view showing a thermal printer according to the present invention.

FIGS. 6*a*–6*d* are explanatory views showing the operation of a clamping mechanism for use in the thermal printer of FIG. 1.

Figure 7:
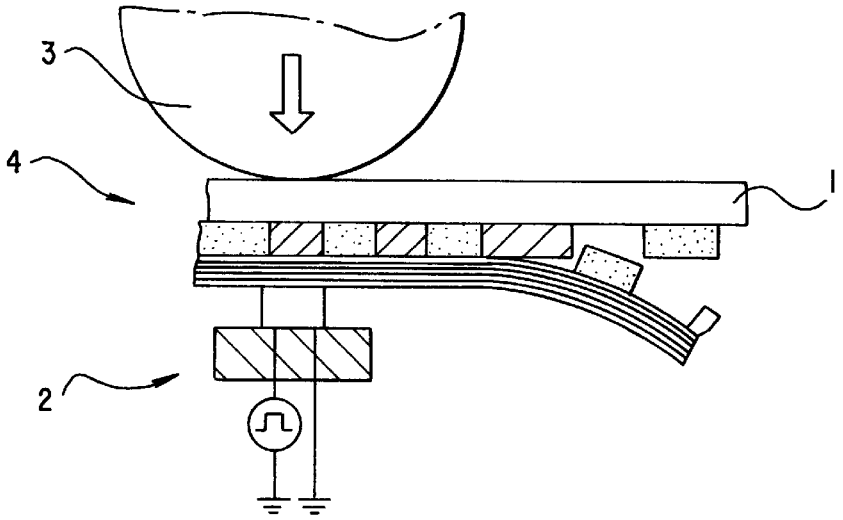
FIG.7 PRIOR ART

FIG. 7 is an explanatory view showing the basic construction of a conventional thermal printer.

Figure 8:
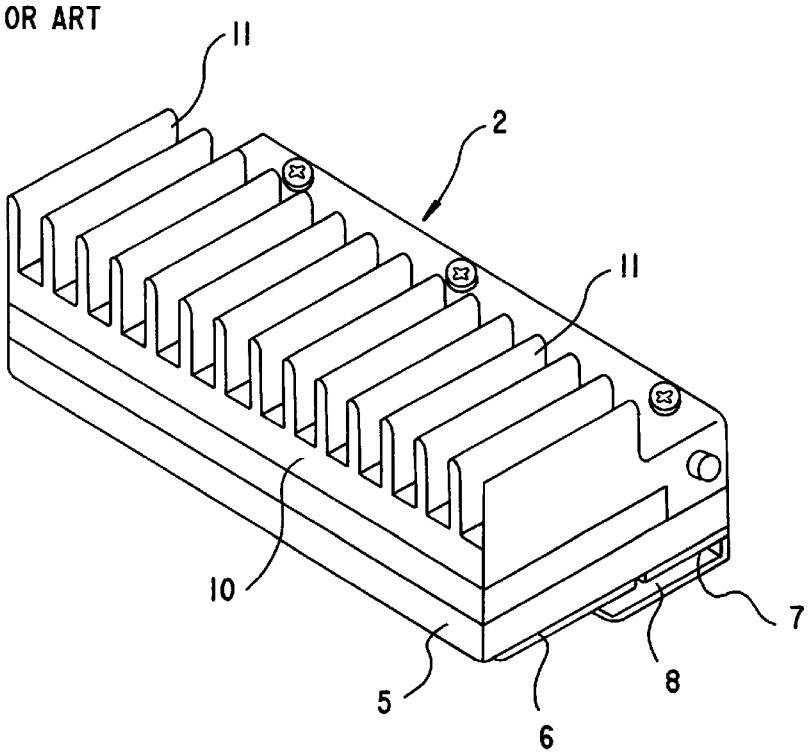
FIG.8 PRIOR ART

FIG. 8 is a perspective view showing a thermal head for use in the thermal printer of FIG. 7.

Figure 9:
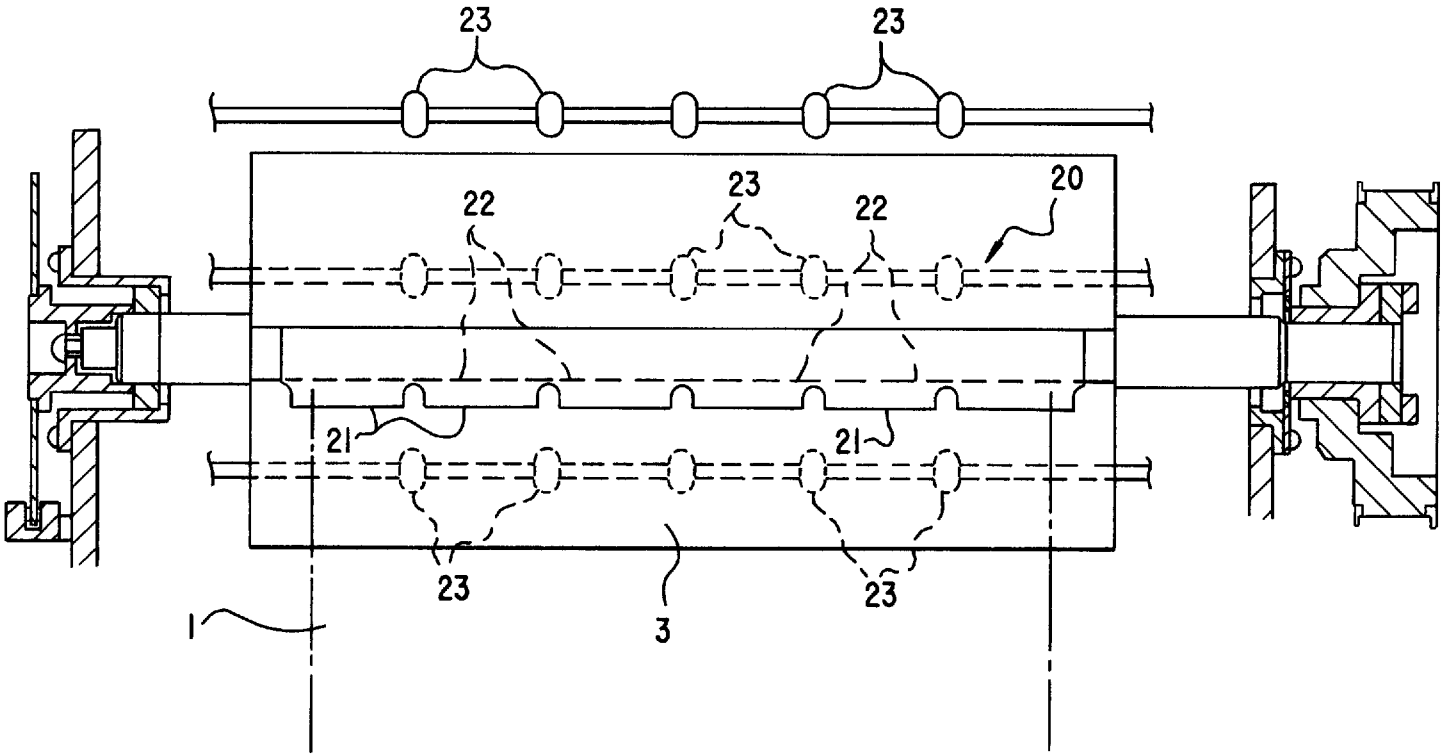
FIG.9 PRIOR ART

FIG. 9 is an explanatory view showing a clamping means for use in the thermal printer of FIG. 7.

DETAILED DESCRIPTION OF THE PREFERRED EMBODIMENTS

Figure 2:
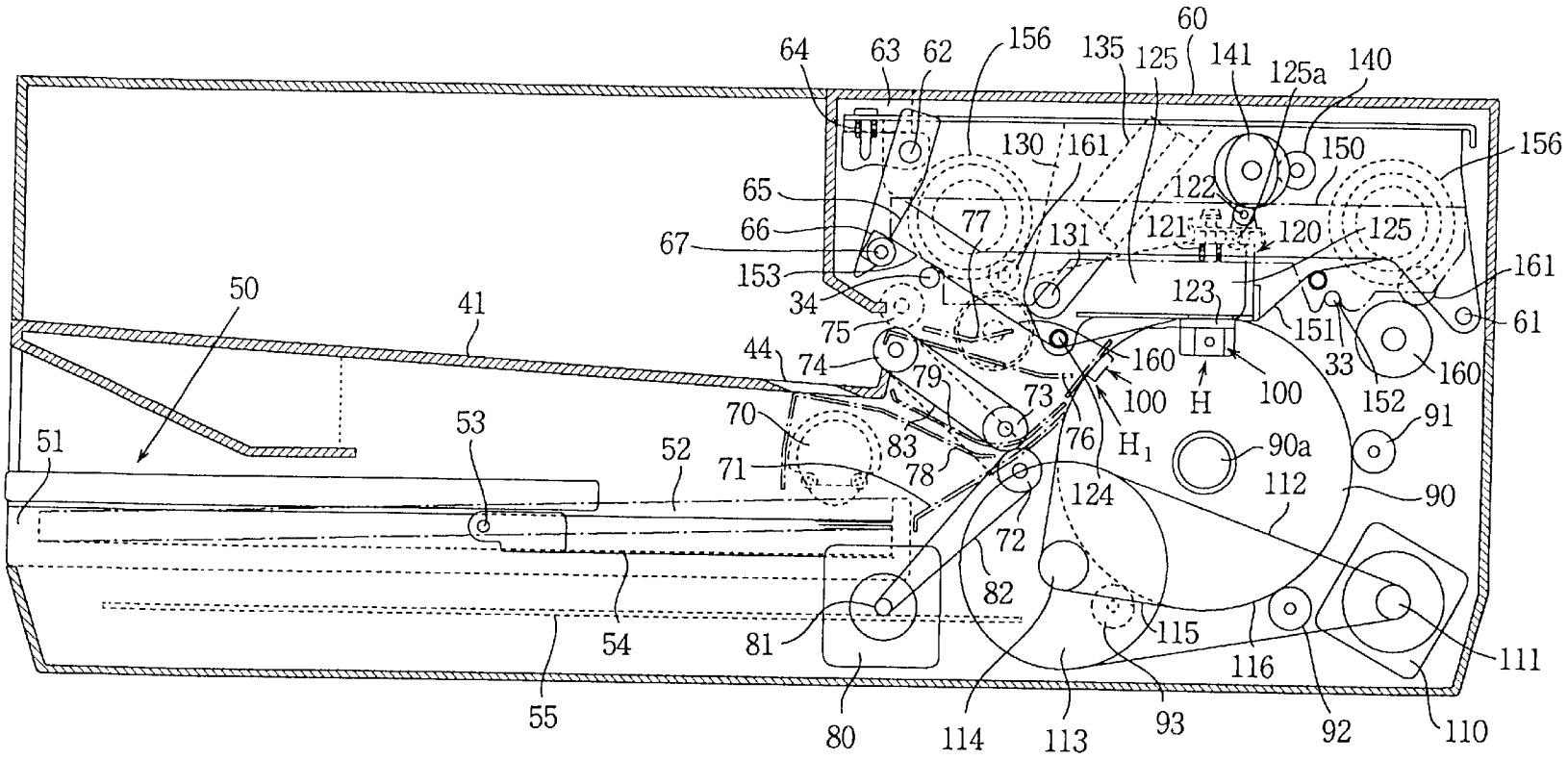
FIG. 2 is a cross sectional view showing the inner structure of the thermal printer of FIG. 1.

Referring to FIGS. 1 and 2, a thermal printer 30 of the present invention comprises a casing 31 and a paper feeding/discharging section 40. The paper feeding/discharging section 40 has a bedplate 41 which has a plurality of elongated ribs 42 formed on the surface thereof. The ribs 42 are used to raise a printed paper a little so as to prevent a printed paper from cling to the bedplate 41, which is otherwise unavoidable due to an electrostatic effect when a printed paper is being discharged to the bedplate 41.

An elongated opening 44 for feeding paper by hand is formed in the inner portion of the bedplate 41. If a paper 52 is to be fed into the printer by hand-operation, the paper may be guided by a pair of guide members 43 so as to be set on the bedplate 41. Then, with the front portion of the paper 52 being fed by hand into the opening 44, a desired printing operation can be performed. In this way, the feeding/discharging section 40 may be used to receive printed papers discharged from the printer as well as to hand-feed an unprinted paper thereinto.

Provided under the bedplate 41 is a paper holding section 50 including a paper holder 51 for holding a number of unprinted papers 52. Further, a mode setting panel 32 is provided on the front wall of the casing 31, which is used to set a desired operation mode for the thermal printer 30.

A cover member 60 is provided such that it can be opened and closed on the casing 31, with the shaft 61 (see FIG. 2) as a fulcrum point. Provided on the front end of the cover member 60 is a lock releasing member 63 which is pivotable about a shaft 62 and is constantly urged downwardly by a spring 64. A hook member 65 is pivotably installed on the shaft 62. When the cover member 60 is closed upon the casing 31, the hook portion 66 of the hook member 65 is caused to engage with the retaining shaft 67, so that the cover member 60 is prevented from opening.

When the cover member 60 is to be opened, the lock releasing member 63 is pushed to pivot about the shaft 62, so that the hook portion 66 of the hook member 65 is released from the retaining shaft 67, thus opening the cover member 60.

Referring to FIG. 2, under the bedplate 41, there is further provided a paper feeding roller 70 and a circuit substrate 55 holding various electronic elements.

Within the paper holder 51, there is provided a pressing member 54 which is pivotable about a fulcrum 53. The pressing member 54 is so installed that when the paper holder 51 holding an amount of papers is set into the holding section 50, the pressing member 54 is pushed upwardly by a projection (not shown) to press the papers upwardly against the paper feeding roller 70.

A paper 52 being fed by the feeding roller 70 from the paper holder 51 is guided by a guide member 71, so as to be caught between two rollers (72, 73). With the rotation of the two rollers (72, 73), the paper 52 is moved toward a drum 90 which is rotatable about a shaft 90*a*.

A driving force for driving the rollers 72 and 73 is obtained from a paper feeding motor 80 through a belt 82 engaging around a pulley 81. On the other hand, a driving force from the roller 73 is transmitted through a belt 83 to another two rollers 74 and 75 for discharging a printed paper.

When a paper 52 is fed from the rollers (72, 73), the drum 90 is rotated from its home position H to a position H1 toward the rollers (72, 73), so that the front portion of the paper 52 is clamped by a clamping mechanism 100 to the drum 90.

Figure 3:
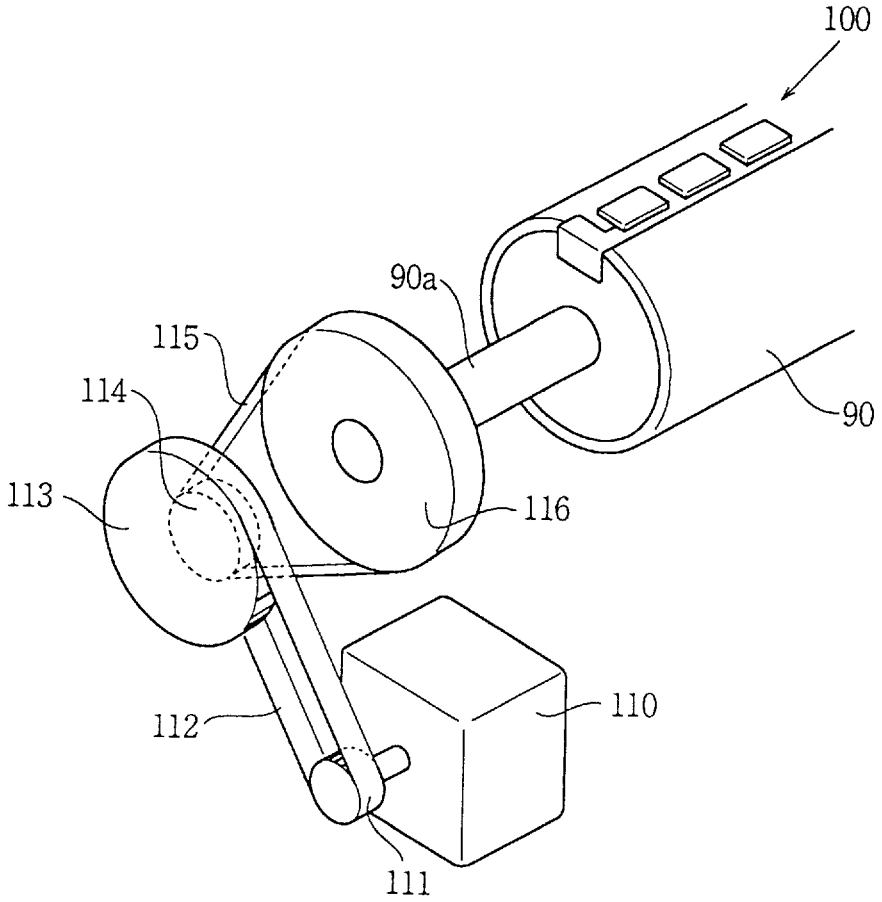
FIG. 3 is a perspective view showing a drum driving system of the thermal printer of FIG. 1.

Further, pressing rollers (91, 92, 93) are provided around the periphery of the drum 90, so that when the drum 90 rotates the paper 52 as a whole may be clamped over the outer periphery surface of the drum 90 with a predetermined tension. As illustrated in FIG. 3, a driving force for driving the drum 90 is obtained from a motor 110, through a pulley 111, belt 112, a pulley 113, a pulley 114 coaxial with the pulley 113, a belt 115, a pulley 116 and the shaft 90*a*. Here, the inner surfaces of the belts 112 and 115 are provided with a number of small lugs (not shown), and the outer periphery of the pulleys 111, 113, 114 and 116 are provided with a number of grooves (not shown), thus the belts 112 and 115 can exactly engage around the pulleys 111, 113, 114 and 116, preventing any possible slipping. Further, since there is an integral-multiple relation between the number of grooves of the pulley 113 and that of the pulley 111, and an integral-multiple relation between the number of grooves of the pulley 116 and that of the pulley 114, the rotation of the drum 90 may be exactly controlled in a predetermined manner so as to achieve a desired printing operation.

Referring again to FIG. 2, when a printed paper is to be discharged, the drum 90 is rotated in the counterclockwise direction and the clamping mechanism 100 is released, so that the printed paper is moved outwardly along the guide members (76, 77), and discharged over to the bedplate 41 by means of two rollers (74, 75).

On the other hand, if a paper 52 is to be fed into the printer by hand, the paper 52 should be fed through the opening 44, and then the paper 52 is guided by the guide members (78, 79) so as to move to the rollers (72, 73). Thus, with the rotation of the rollers (72, 73) and the rotation of the drum 90, the paper 52 is clamped to the drum 90 by means of the clamping mechanism 100 and rolled up around the outer periphery surface of the drum 90.

After the printing operation is finished, the printed paper 52 is discharged over to the plate 41 in the same manner as described above.

Figure 4:
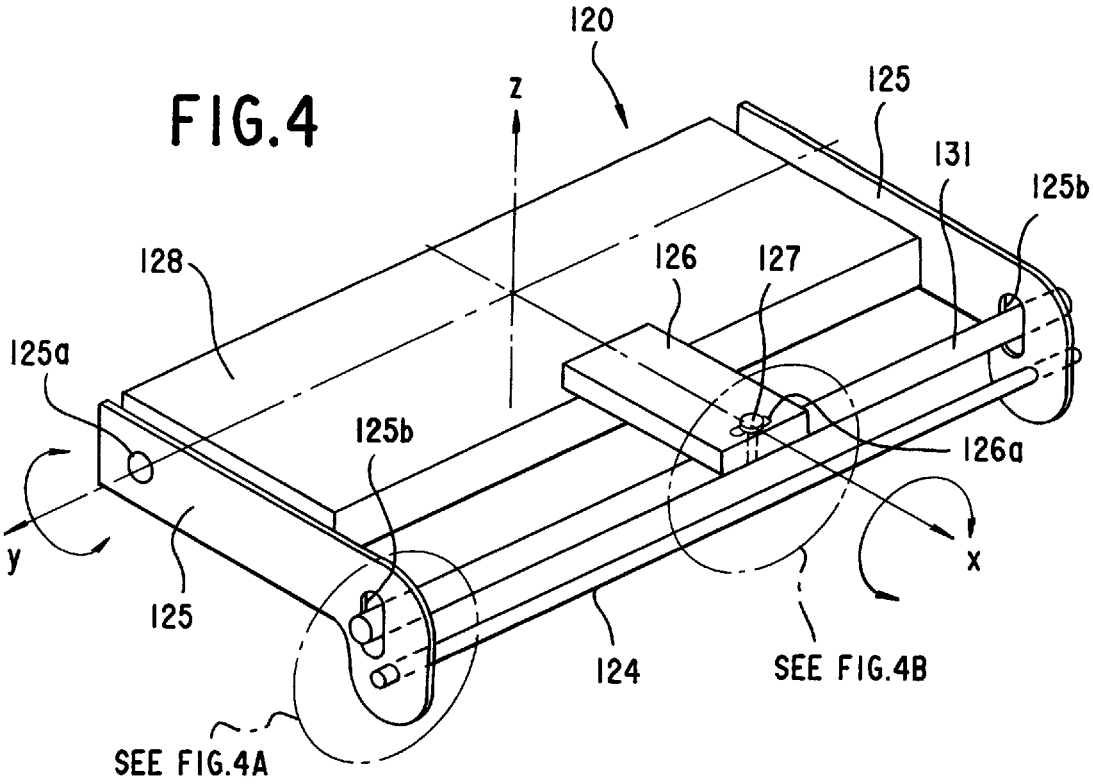
FIG. 4A, 4B is a perspective view showing a thermal head unit used in the thermal printer of FIG. 1.
Figure 4B:
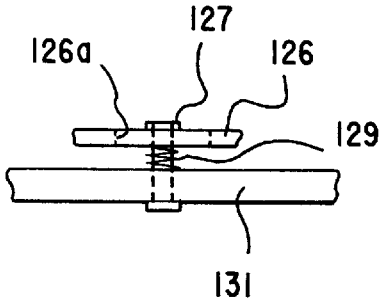
Figure 4A:
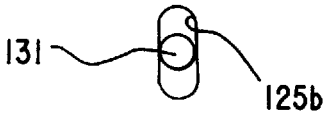

FIG. 4 illustrates a thermal head unit 120 for use in the the thermal printer 30, which includes the most important improvement according to the present invention. Referring to FIG. 4, the thermal head unit 120 has a main body 128, and a pair of brackets (125, 125) attached at the ends thereof on the opposite sides of the main body 128. The two brackets (125, 125) are so installed that they are extending in the x direction and pivotable about shafts 125*a* extending in the y direction. Further, the front end portion of each bracket 125 is formed with an elongated hole 125*b* extending in the z direction. Into the elongate holes (125*b*, 125*b*) is inserted a shaft 131 which is installed on brackets 130 (see FIG. 2) secured on the inner wall of the cover member 60. The two elongated holes (125*b*, 125*b*) are so formed that the thermal head unit 120 is vertically pivotable about the shaft 125*a*, but not moveable in the x direction.

Further, another bracket 126 is provided on the middle portion of the thermal head unit 120. Such bracket 126 is formed with an elongated hole 126*a* extending in the y direction, and a bolt 127 is inserted through the hole 126*a* so as to be secured on the shaft 131. The elongated hole 126*a* is so formed that the thermal head unit 120 is vertically slightly pivotable about the bolt 127, but not moveable in the x direction.

Anyway, the elongated holes (125*b*, 125*b*) and the elongated hole 126*a* are so formed as to ensure that the thermal head unite 120 will not pivot horizontally about z axis, thereby preventing an undesired pivoting movement of the head unit 120, which will otherwise cause a difficulty in obtaining a predetermined printing effect.

Furthermore, since the elongated hole 126*a* is so formed that the thermal head unit 120 is vertically slightly pivotable about the bolt 127, it is possible for a thermal head 123 provided immediately under the main body 128 to absorb thickness difference in one piece of a paper, so that the thermal head 123 can more uniformly get contact with the paper 52.

In addition, since a spring 129 is interposed between the bracket 126 and the shaft 131, it is possible to absorb a vibration caused when the thermal head unit 120 get into contact with the drum 90. Thus, it is possible to prevent the thermal head unit 120 from getting into a deviated position even if it has been used for a long period, thereby ensuring a reliable printing operation.

Referring to FIG. 2, one side of the thermal head unit 120 is urged upwardly by means of a spring 121. A roller 122 is provided on the same side of the thermal head unit 120. A motor 140 for driving the thermal head unit 120 is provided near by so as to drive a rotational cam 141 which in contact with the roller 122. When pressed by the cam 141 which is driven by the motor 140, said side of the thermal head unit 120 may be driven up and down.

Further provided on the bracket 130 is a cooling fan 135 which is used to send a cooling air to cool the thermal head 123 of the thermal head unit 120, thereby controlling the the temperature of the thermal head 123.

Referring again to FIG. 2, on the other side of the thermal head unit 120, there is provided a shaft 124 which is employed to press an ink film 151 against the paper 52 rolled around the periphery of the drum 90.

Figure 5:
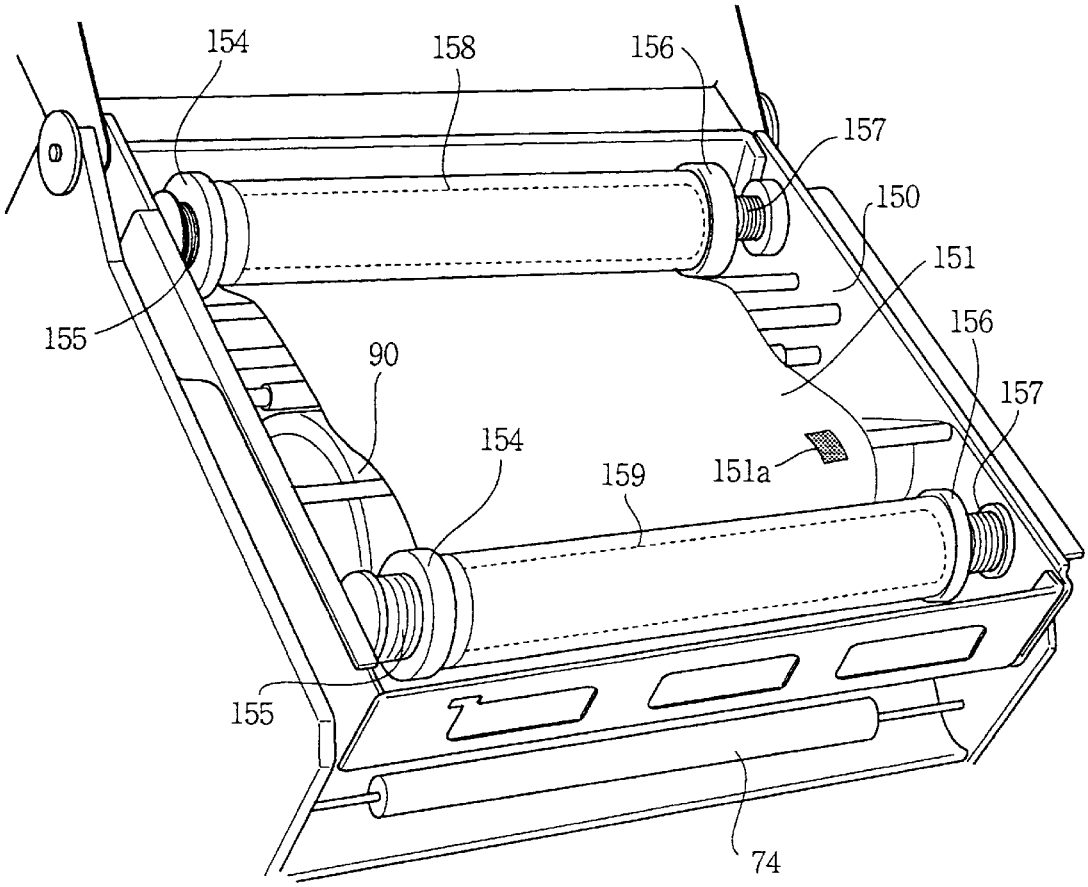
FIG. 5 is a perspective view showing a ink film unit to be installed in the thermal printer of FIG. 1.

Referring to FIG. 5, the ink film 151 is disposed in a film unit 150. As shown in FIG. 2, the film unit 150 has two recess portions 152 and 153 which engage on two shafts 33 and 34 provided in the casing 31, thus the film unit 150 can be easily installed at a predetermined position in the casing 31.

As illustrated in FIG. 5, the film unit 150 comprises a pair of cylindrical reel members (158, 159) for rolling up and holding the ink film 151. Here, the ink film 151 is supplied from the reel member 159 and is rolled up on the reel member 158. On one end of each reel member 158(159), there is provided a slipping clutch 154 which is urged inwardly by a tension spring 155. On the other end of each reel member 158(159), there is provided a retaining member 156 which is urged inwardly by a spring 157.

The ink film 151 includes, for example, four color areas (yellow, magenta, cyanogen, black) which are arranged successively and in a manner such that the four color areas appear repeatedly along the length direction thereof. Each color area has an identification mark 151*a* provided to identify what color area it is.

When the ink film 151 is supplied from the reel member 159, the identification mark 151*a* is detected by an ink film sensor (not shown). Then, the front portion of the paper 52 may be adjusted to be coincident with that of a color area which has been identified.

Further, each color area of the ink film 151 is set to be slightly larger than a paper 52, so that when the position of a paper 52 is adjusted in order to be coincident with a color area, the paper 52 may be easily covered by the color area of the ink film 151.

As illustrated in FIG. 2, driving forces from motors 160 are transmitted through gears 161 to ink film unit 150. Since the motors 160 are stepping motors, the motors 160 are pulse-controlled so that they can rotate in a stabilized manner. In this way, the ink film 151 may be supplied from the reel member 159 in a controlled and stabilized manner, so as to perform a desired printing operation.

Now, a detailed description will be given to the clamping mechanism 100 with reference to FIGS. 6*a*–6*d*.

Figures 6A, 6B, 6C, 6D:
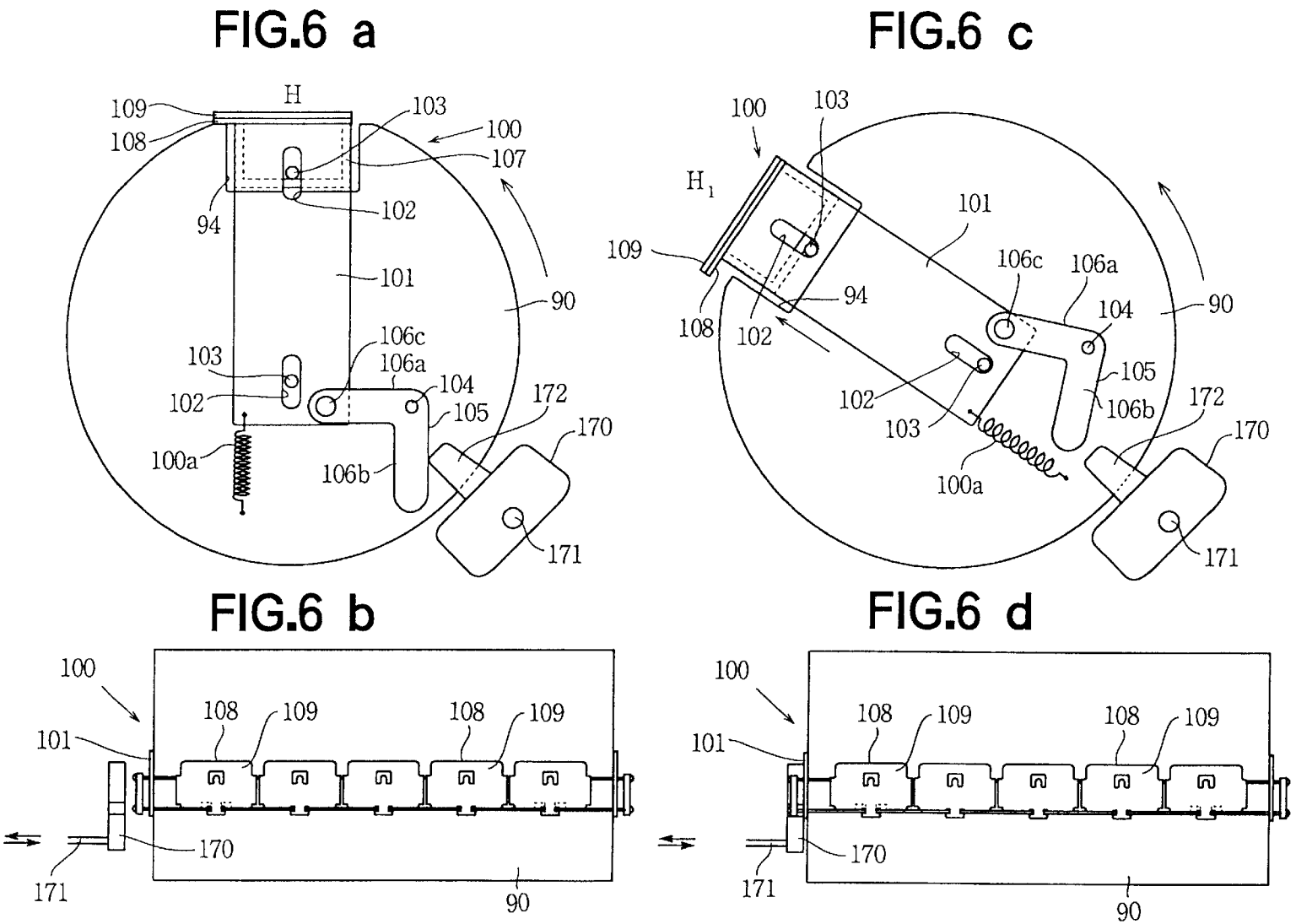

Referring to FIG. 6*a*, the clamping mechanism 100 has two sliding members 101 each being positioned on each end face of the drum 90. The sliding member 101 is so provided so as to be moveable in the radial direction of the drum 90 and is urged inwardly by a spring 100*a*. Each sliding member 101 has two guide holes 102 into which are inserted two guide pins 103, thus the moving quantity of the sliding member 101 is restricted.

Further, connected via a shaft 106*c* to one end of each sliding member 101 is a L-shaped arm member 105 which is pivotable about the shaft 106*c*. The L-shaped arm member 105 is also pivotably linked to the drum end surface via another shaft 104. Adjacent to the drum end surface is provided a moving member 170 which is so provided as to easily advance to or retreat from. the drum end face (see FIG. 6*b*). As illustrated in FIG. 6*a*, when the moving member 170 moves to the moving locus of the arm member 105 on the drum end face, a front portion 106*b* of the arm member 105 will come into contact with the projection 172 of the moving member 170.

The advancing and retreating movement of the moving member 170 may be effected by moving a shaft 171 which is controlled by a solenoid (not shown). When the moving member 170 staying on the moving locus of the arm member 105 (as shown in FIG. 6*a*) is rotated in the counterclockwise direction, the arm member 105 is caused to pivot about the shaft 104, pressing against the moving member 170 (as shown in FIG. 6*c*). Thus, the sliding member 101 is pushed upwardly against the urging force of the spring 100*a*.

Between the two sliding members (101, 101) disposed on the opposite end faces of the drum 90, there is provided an elongated and substantially U-shaped member 107 (having a U-shaped cross section) which is adapted to fit into an elongated groove 94 formed on the outer periphery of the drum 90 along the longitudinal direction thereof. The U-shaped member 107 is provided with a plurality of clamp members 108, each being independently held by one leaf spring 109. By independently holding the clamp members 108 on the U-shaped member 107, it is possible for the front portion (to be clamped by the clamp members 108) of the paper 52 to be uniformly pressed, corresponding to thickness difference of a single piece of paper. Accordingly, it is able to prevent a clamped paper from deviating its correct position when a printing operation begins.

The operation of the thermal printer constructed according to the present invention, will be described in detail as follows.

Referring to FIG. 2, when the motor 110 is switched ON, a driving force is transmitted to the drum 90, by way of the pulley 111, the belt 112, the pulley 113, the pulley 114 coaxial with the pulley 113, the belt 115, the pulley 116 and the shaft 90*a*.

At this time, if the drum 90 is in the position H1 shown in FIG. 6*c*, the drum 90 will be rotated to the home position H shown in FIG. 6*a*. When the drum 90 is rotated from the position of FIG. 6*c* to the position of FIG. 6*a*, the front end of the portion 106*b* of the arm member 105 moves from the front end of the projection 172 of the moving member 170. Meanwhile, since the sliding member 101 is urged downwardly by the spring 110*a*, the U-shaped member 107 is caused to fit into the elongated groove 94 of the drum 90, thus the clamping mechanism 100 has become to a DOWN condition.

The DOWN condition of the clamping mechanism 100 is then detected by a clamp sensor (not shown), and the shaft 171 is drawn back (see FIG. 6*b*) by means of a solenoid (not shown), thus the projection 172 of the moving member 170 is caused to move away from the end face of the drum 90.

On the other hand, the home position H of the drum 90 is detected by a drum position sensor (not shown), and the drum driving motor 110 is stopped.

Subsequently, the thermal head driving motor 140 is operated to drive the cam 141. When the cam 141 rotates, the roller 122 is urged upwardly by the springs 121 so that the roller 122 is always in contact with the rotating cam 141. Accordingly, with the rotation of the cam 141, the thermal head unit 120 moves upwardly from the drum 90, and becomes to an UP position. When the UP position of the thermal head unit 120 is detected, the motor 140 is stopped, whilst the ink film driving motors 160 are started.

With the driving force from the motors 160, the cylindrical reel member 158 is rotated through the clutch 154 (see FIG. 5), so that the ink film 151 is rolled up on the reel member 158. After that, the identification mark 151*a* of a color area of the ink film 151 will be detected by an ink film sensor (not shown), thus the front portion of the color area of the film may be caused to be coincident with that of a paper.

The clamping of the paper 52 may be effected in the following manner. Namely, when the drum 90 is in its home position H shown in FIG. 6*a*, the shaft 171 is pushed toward the drum 90 as shown in FIG. 6*d*, so that the projection 172 of the moving member 170 arrives at the moving locus of the arm member 150. Then, upon the rotation of the drum 90 in the counterclockwise direction, the portion 106 of the arm member 105 is pushed by the projection 172 of the member 170, so that the arm member 105 rotates in the clockwise direction with the shaft 104 serving as a fulcrum. With the rotation of the arm member 105 in this manner, the sliding member 101 is pushed upwardly against the urging force of the spring 100*a*. At this moment, as shown in FIG. 6*c*, the clamping members 108 are lifted a little from the periphery surface of the drum 90, and the UP position of the clamping members 108 is detected by a clamp sensor (not shown).

Then, the motor 110 is stopped and the paper feeding roller 70 is driven, therefore a paper 52 is dragged from the paper holder 51 and is guided by the guide member 71, so as to be moved to the drum 90, by virtue of the rollers (72, 73) being driven by motor 80.

This time, the drum 90 remains in the position H1 (FIG. 6*c*) and the clamp members 108 are still in the UP position. The front portion of the paper 52 is abutted against the side wall of the U-shaped member 107, so that the front edge of the paper 52 is alined with side wall of the member 107. then the drum 90 is rotated in the clockwise direction, the front end of the portion 106*b* of the arm member 105 moves away from the front portion of the projection 172 of the moving member 170, so that the sliding member 101 is dragged down by the urging force of the spring 100*a*. In this way, the front portion of the paper 52 is clamped by the clamp members 108 to the drum 90. In such an operation, since each of the clamp members 108 is independently held by one leaf spring 109, it is possible for the front portion of the paper 52 to be uniformly pressed by the clamping mechanism 100, corresponding to the thickness difference of single one piece of paper. Accordingly, it is able to prevent a clamped paper from deviating its correct position when a printing operation begins.

After the DOWN position of the clamping mechanism 100 (clamp members 108) is detected by the clamp sensor (not shown), the shaft 171 is dragged back by the effect of an solenoid (as shown in FIG. 6*b*), so that the projection 172 of the moving member 170 is caused to move away from the moving locus of the arm member 105.

Subsequently, the drum 90 is rotated in the clockwise direction for more than 360° , so as to return back to the home position H shown in FIG. 6*a*. With the rotation of the drum 90 in this manner, the paper 52 is rolled up around the outer periphery surface of the drum 90. Further, with the use of the pressing rollers 91, 92 and 93, the paper 52 is tightly fit over the outer periphery of the drum 90.

On the other hand, when a paper 52 is to be fed by hand operation, the paper is fed into the printer through the opening 44, guided by the guide means (78, 79), passing between the feeding rollers (72, 73), so as to arrive at drum 90. After the completion of the process which is the same as above, the paper 52 may be tightly fit over the outer periphery of the drum 90.

The printing operation will be described in detail below.

Referring to FIG. 2, when the printing operation is to be performed, the head driving motor 140 is operated to cause the thermal head unit 120 to approach to the drum 90, so that the thermal head 123 can press the ink film 151 against the paper 52. Then, the motor 140 is stopped, whilst the drum motor 110 and the ink film motors 160 are operated, so that a first color may be printed on the paper 52.

Similar to the prior art, the ink film 151 includes four color areas (yellow, magenta, cyanogen, black) which are arranged successively and in a manner such that the four color areas appear repeatedly on the ink film 151 along the entire length thereof.

As soon as the printing of a first color (yellow) is finished, a second color (magenta) is printed on the same paper 52 in the same manner. In this way, a third color (cyanogen) and a fourth color (black) may be printed on the same paper 52 so as to obtain a completed color picture.

In the same manner as in a conventional thermal printer, during printing operation, the drum 90 is rotated in a speed corresponding to a printing speed of the thermal head 123, whilst the ink film 151 is moved in a speed corresponding to the drum speed.

In detail, after the printing of a first color (yellow) is finished, the motor 110 and the motors 160 are stopped. Then, the motor 140 is operated to cause the thermal head unit 120 (including the thermal head 123) to move from the drum 90. Afterwards, the motor 110 and the motor 160 are operated, such that the front portion of the yellow-printed paper 52 is caused to be coincident with that of a second color (magenta) area of the ink film 151.

Since there is an integral multiple relation between the number of grooves of the pulley 113 and that of the pulley 111, and an integral multiple relation between the number of grooves of the pulley 116 and that of the pulley 114, the rotation of the drum 90 may be exactly controlled in a predetermined desired manner, so that it is sure that the front portion of the paper 52 will be easily made coincident with that of a second color (magenta) area of the ink film 151.

The printing of the second color (magenta) on the identical paper 52 on which the first color (yellow) has been printed, is performed in the same manner as the first color (yellow).

In this way, a third color (cyanogen) and a fourth color (black) may be similarly printed on the same paper 52 so as to obtain a completed color picture.

During the above printing operation, as indicated in FIG. 4, since the thermal head unit 120 is vertically pivotable about the shaft 125*a* but not moveable in the x direction, and since the thermal head unit 120 is also vertically slightly pivotable about the bolt 127 but not movable in the x direction, it is possible for a thermal head 123 provided immediately under the main body 128 to absorb thickness difference in a single piece of paper 52, so that the thermal head 123 can get more uniform contact with the paper 52.

Further, during the printing operation, as indicated in FIG. 4, since the spring 129 is interposed between the bracket 126 and the shaft 131, it is possible for the thermal head unit 120 to absorb a vibration caused when the thermal head unit 120 gets into contact with the drum 90. Thus, it is possible to prevent the thermal head unit 120 from getting into a deviated position even if it has been used for a long period, thereby ensuring a reliable printing operation.

The printed paper 52 having a completed picture is discharged in the following manner.

At first, the thermal head driving motor 140 is operated to cause the thermal head unit 120 (including the thermal head 123) to move from the drum 90. Afterwards, the drum driving motor 110 is operated to cause the drum 90 to rotate in the counterclockwise direction. At this time, although the front portion of the paper 52 is still clamped by the clamping mechanism 100, the rear portion of the paper is in free state, therefore the rear portion of the paper 52 is guided by the guide members (76, 77) and caught between the discharging rollers (74, 75), so as to be discharged to the bedplate 41 by releasing the clamping action of clamping mechanism 100 on the paper 52.

A paper fed into the printer 30 by hand operation, upon completion of the desired printing, may be discharged therefrom in the same manner.

While the presently preferred embodiments of the this invention have been shown and described above, it is to be understood that these disclosures are for the purpose of illustration and that various changes and modifications may be made without departing form the scope of the invention as set forth in the appended claims.

What is claimed is:

1. A thermal printer for performing a printing operation by means of heat, comprising:

a casing:

a drum means, provided within the casing, for rolling up a paper for printing;

a thermal head unit is provided within the casing for producing a heat for the printing operation;

wherein the thermal head unit having a main body and a pair of brackets provided on opposite sides of said main body, each of the pair of brackets is formed, at a first end thereof, with an elongated hole into which a fixed elongated shaft is inserted, and each of the pair of brackets being supported, at a second end thereof, on said main body, wherein each elongated hole is formed such that the thermal head unit is pivotable about the fixed elongated shaft only in a direction perpendicular to a printing direction.

2. The thermal printer according to claim 1, wherein each elongated hole are formed with the longitudinal axis arranged in the pivoting direction of the thermal head unit.

3. The thermal printer according to claim 1, wherein into the two elongated hole of each pair of brackets is inserted an elongated shaft secured within the casing, so that the elongated shaft extends between the pair of brackets.

4. The thermal printer according to claim 1, wherein the thermal head unit further includes an intermediate bracket provided on a center of the thermal head unit.

5. The thermal printer according to claim 4, wherein the intermediate bracket is formed with an elongated hole, a bolt member is inserted through the elongated hole of the intermediate bracket and is fixed on the fixed elongated shaft, extending between the elongated holes of the pair of brackets such that the thermal head unit is slightly vertically pivotable about the bolt member.

6. The thermal printer according to claim 5, wherein between the intermediate bracket and the elongated shaft is provided a spring means for absorbing a vibration applied to the thermal head unit.

7. The thermal printer according to claim 1, wherein the drum means is provided with a clamp mechanism having a plurality of clamp members each being independently held by a leaf spring.

8. The thermal printer according to claim 1, wherein the drum means is further provided with a pair of sliding members on each end face of the drum means, each of said sliding member is urged by a spring and is caused to cooperate with an arm member and a moving member, so as to cause the sliding members to slide up and down along the end faces of the drum means.

9. The thermal printer according to claim 8, wherein the moving member is controlled by a solenoid to advance to and retreat from a moving locus of the arm member on the end face of the drum means.

* * * * *